US010022583B2

(12) United States Patent
Wang

(10) Patent No.: US 10,022,583 B2
(45) Date of Patent: Jul. 17, 2018

(54) BASE SUPPORT FOR DUMBBELL ASSEMBLY

(71) Applicant: Beto Engineering & Marketing Co., Ltd., Taichung (TW)

(72) Inventor: Lo Pin Wang, Taichung (TW)

(73) Assignee: Beto Engineering & Marketing Co., Ltd., Beitun, Taichung (TW)

( * ) Notice: Subject to any disclaimer, the term of this patent is extended or adjusted under 35 U.S.C. 154(b) by 239 days.

(21) Appl. No.: 15/060,701

(22) Filed: Mar. 4, 2016

(65) Prior Publication Data

US 2017/0252599 A1 Sep. 7, 2017

(51) Int. Cl.
*A63B 21/072* (2006.01)
*A63B 21/075* (2006.01)

(52) U.S. Cl.
CPC ..... *A63B 21/075* (2013.01); *A63B 21/072* (2013.01); *A63B 21/0726* (2013.01); *A63B 21/0728* (2013.01)

(58) Field of Classification Search
CPC ..... A63B 21/072; A63B 21/0722; A63B 21/0724; A63B 21/0726; A63B 21/0728; A63B 21/075
See application file for complete search history.

(56) References Cited

U.S. PATENT DOCUMENTS 5,839,997 A 11/1998 Roth et al.
6,416,446 B1 7/2002 Krull
6,656,093 B2 12/2003 Chen
6,669,606 B2 12/2003 Krull
6,719,674 B2 4/2004 Krull
7,137,931 B2 11/2006 Liu
7,153,243 B1 12/2006 Krull
7,172,536 B2 2/2007 Liu
7,223,214 B2 5/2007 Chen
7,261,678 B2 * 8/2007 Crawford ..... A63B 21/0607 482/107
7,485,077 B2 2/2009 Chen
2008/0032874 A1 * 2/2008 Towley ..... A63B 21/0726 482/106
2009/0124470 A1 * 5/2009 Yu ..... A63B 21/075 482/107
2009/0186748 A1 * 7/2009 Golesh ..... A63B 21/0728 482/107
2014/0349820 A1 * 11/2014 Wang ..... A63B 21/075 482/108
2015/0360073 A1 * 12/2015 Moran ..... A63B 21/075 482/107
2016/0059064 A1 * 3/2016 Smith ..... A63B 21/0728 482/5

(Continued)

*Primary Examiner* — Joshua Lee
(74) *Attorney, Agent, or Firm* — Charles E. Baxley

(57) ABSTRACT

A dumbbell assembly includes a number of weight members, a handle device engageable with the weight members for anchoring a selected number of the weight members to the handle device, a base support includes a number of socket openings for accommodating the weight members, and a follower is slidably engaged in the base support, and the follower includes one or more catches for selectively engaging with the weight members that are supported on the base support and for selectively retaining the weight members to the base support. A spring biasing member is engaged with the follower for biasing the catches of the follower to engage with the weight members.

7 Claims, 6 Drawing Sheets

(56) References Cited

U.S. PATENT DOCUMENTS

| | | | | |
|---|---|---|---|---|
| 2016/0089560 | A1* | 3/2016 | Smith | A63B 24/0087<br>482/108 |
| 2016/0089575 | A1* | 3/2016 | Smith | H04M 1/72533<br>482/5 |
| 2016/0166873 | A1* | 6/2016 | Liu | A63B 21/0726<br>482/107 |
| 2016/0184623 | A1* | 6/2016 | Moran | A63B 21/075<br>482/8 |

* cited by examiner

BASE SUPPORT FOR DUMBBELL ASSEMBLY

BACKGROUND OF THE INVENTION

1. Field of the Invention

The present invention relates to an adjustable exercise device or dumbbell or barbell or the like, and more particularly to an adjustable exercise device or dumbbell including an improved base support for solidly and stably anchoring or positioning the weight members to the base support and for preventing the weight members from being disengaged or removed or separated from the base support inadvertently.

2. Description of the Prior Art

Typical exercise devices or barbells or dumbbells comprise a central handle member to be grasped or held by the user, and a number of weight plates to be attached onto the ends of the handle member for weight lifting or exercising purposes, or for exercising or training the upper muscle groups or the lower muscle groups of the user.

For example, U.S. Pat. No. 5,839,997 to Roth et al., U.S. Pat. No. 6,416,446 to Krull, U.S. Pat. No. 6,656,093 to Chen, U.S. Pat. No. 6,669,606 to Krull, U.S. Pat. No. 6,719,674 to Krull, U.S. Pat. No. 7,137,931 to Liu, U.S. Pat. No. 7,153,243 to Krull, U.S. Pat. No. 7,172,536 to Liu, U.S. Pat. No. 7,223,214 to Chen, and U.S. Pat. No. 7,485,077 to Chen disclose several typical adjustable dumbbells each comprising a number of weight plates or weight members selectively or adjustably attaching or mounting onto the handle shaft or handle bar that is provided for being held or grasped by the users to train the upper muscle groups or the lower muscle groups of the user, and a latch device attached onto the handle and/or the weighted plates for selectively or adjustably mounting or securing selected or different number of the weighted plates on the ends of the handle and for exercising or training the upper muscle groups or the lower muscle groups of the user.

A supporting base is further required to be provided for stably supporting the weight plates or weight members in place, and the latch device is required to be moved relative to the handle or the weight plates or weight members or actuated to engage with the required or selected number of the weighted plates or weight members when the weight plates or weight members are supported on or in the supporting base, and before the handle and the weight plates or weight members may be lifted or moved away from the supporting base, and the latch device is required to be moved relative to the handle or the weight plates or weight members or actuated to engage with and to couple the required or selected number of the weighted plates or weight members to the handle before the handle and the weight plates or weight members may be lifted or moved away from the supporting base.

However, the supporting base of the typical adjustable dumbbells are normally provided for supporting the weight plates or weight members only, but may not solidly and stably anchor or latch or retain or position the weight plates or weight members within the supporting base such that the weight plates or weight members may have a good chance to be disengaged or separated from the supporting base.

The present invention has arisen to mitigate and/or obviate the afore-described disadvantages of the conventional adjustable dumbbells.

SUMMARY OF THE INVENTION

The primary objective of the present invention is to provide an adjustable exercise device or barbell or dumbbell assembly including an improved base support for solidly and stably anchoring or positioning the weight members to the base support and for preventing the weight members from being disengaged or removed or separated from the base support inadvertently.

In accordance with one aspect of the invention, there is provided a dumbbell assembly comprising a number of weight members, a handle device selectively engageable with the weight members for selectively anchoring a selected number of the weight members to the handle device, a base support includes a number of socket openings formed therein for accommodating the weight members respectively, and one or more followers are slidably engaged in the base support, and the followers each include at least one catch extended therefrom for selectively engaging with the weight members that are supported on the base support and for selectively retaining the weight members to the base support and for preventing the weight members from being disengaged or removed or separated from the base support inadvertently.

The base support includes a spring biasing member engaged with the follower for biasing and forcing the catches of the follower to engage with the weight members. The base support includes an actuator button slidably engaged in the base support and partially extended out through the base support for selectively moving the follower to compress the spring biasing member and for selectively disengaging or separating or moving the catches of the follower from the weight members.

The follower includes a protrusion having an inclined surface provided thereon, and the actuator button includes an inclined surface provided thereon for slidably engaging with the inclined surface of the protrusion and for selectively moving the follower to compress the spring biasing member when the actuator button is depressed toward the base support.

The base support includes an aperture formed therein for slidably engaging with the actuator button and for allowing the actuator button to be partially extended out through the aperture of the base support and thus for allowing the actuator button to be depressed toward the base support to engage with the protrusion of the follower. The weight members each include a lock notch formed therein for selectively engaging with the catch of the follower. The base support includes at least one key extended therefrom.

The base support includes a chamber formed therein for slidably engaging with the follower. The base support includes a cap attached thereto for enclosing the chamber of the base support and for retaining the follower within the chamber of the base support and for preventing the follower from being disengaged or removed or separated from the base support inadvertently.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
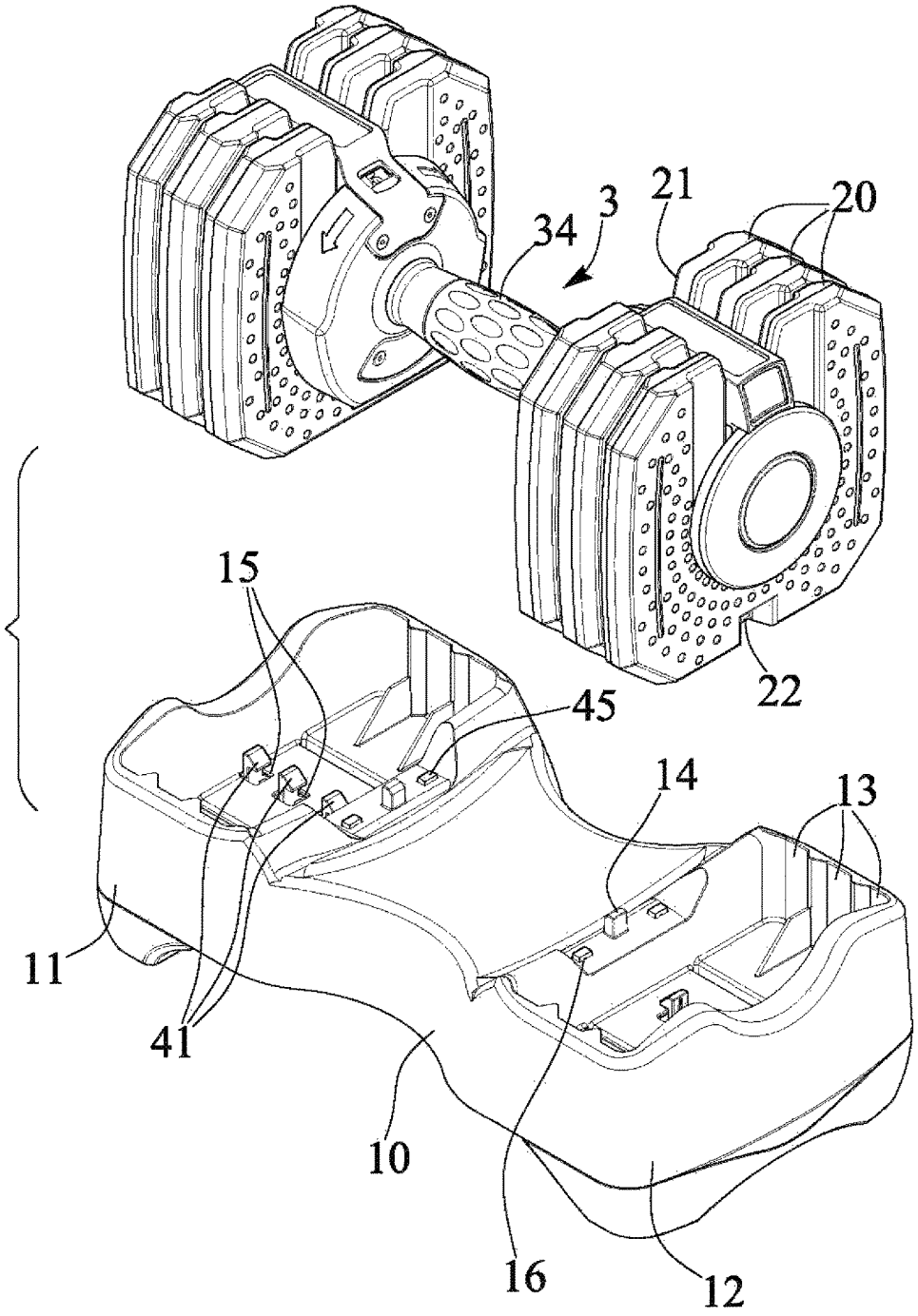
FIG. 1 is a partial exploded view of an adjustable exercise device or barbell or dumbbell assembly in accordance with the present invention.

Referring to the drawings, and initially to FIGS. 1-4, an adjustable dumbbell assembly or barbell or exercise device in accordance with the present invention comprises a receptacle or base support 10 including one or more (such as two) side or end portions 11, 12 each having one or more (such as three) recesses or socket openings 13 formed therein for receiving or accommodating or engaging with the weight plates or weight members 20 respectively, and each having a projection or key 14 extended upwardly therefrom. The weight members 20 each include a U-shaped opening or groove 21 formed therein, and each include a lock notch 22 formed therein, such as formed in the lower or bottom portion of the respective weight member 20.

Figure 3:
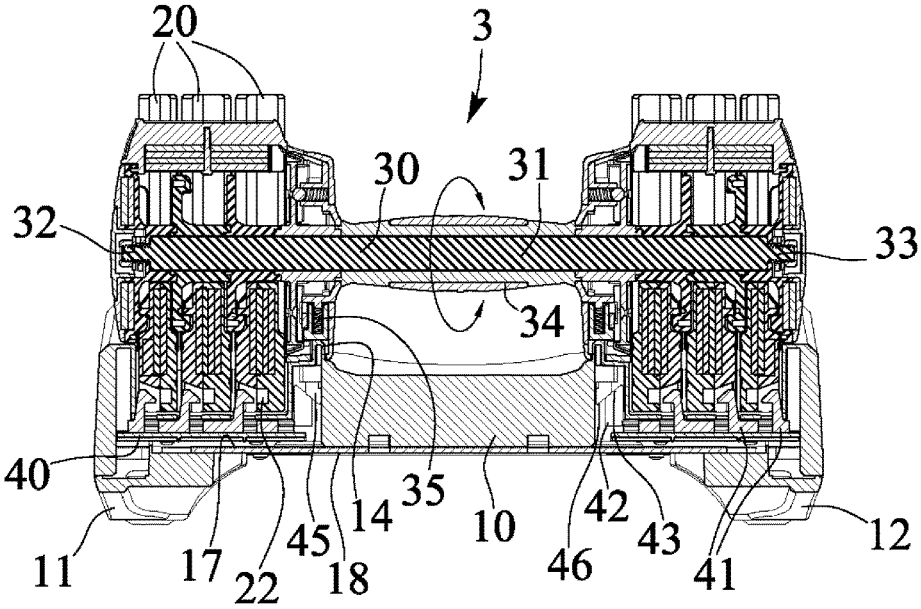
FIG. 3 is a cross sectional view of the adjustable dumbbell assembly, taken along lines 3-3 of FIG. 2.
Figure 5:
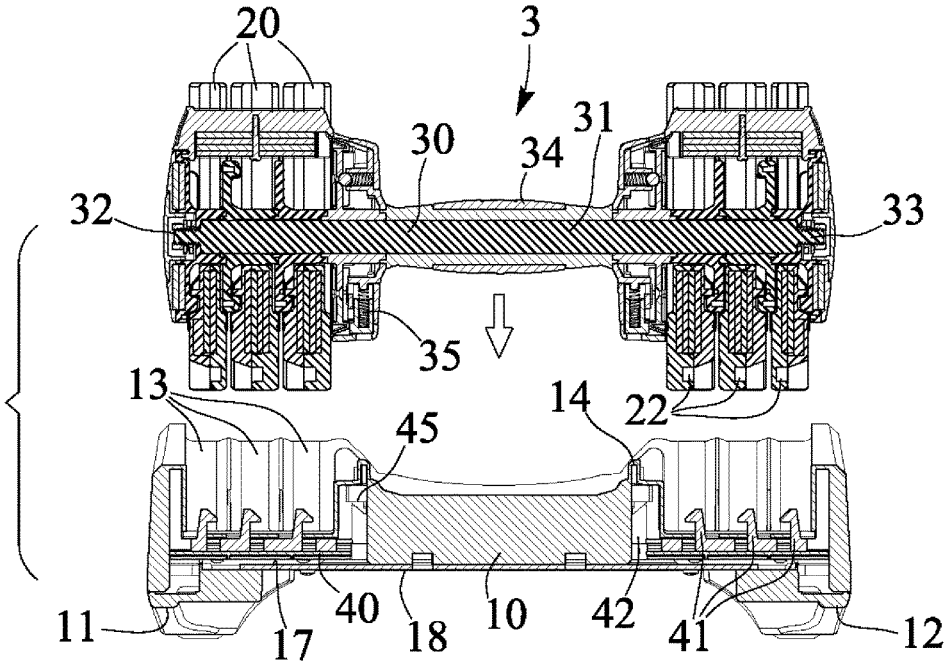
FIG. 5 is a further cross sectional and exploded view of the adjustable dumbbell assembly similar to FIG. 3, in which the handle and the weight members are removed or separated from the base support.

The adjustable exercise device or dumbbell further comprises a handle device 3 including a longitudinal spindle or handle bar 30 having a middle or intermediate portion 31 and two end portions 32, 33, best shown in FIGS. 3, and 5, and a hand grip 34 rotatably disposed or provided on the middle or intermediate portion 31 of the handle bar 30 for being grasped or held by the user and for carrying or lifting or moving the handle device 3 and for allowing the adjustable dumbbell to be easily operated by the user. The hand grip 34 is rotatable relative to the handle bar 30 (FIG. 3). The handle device 3 includes a spring biased lock or latch 35 for selectively engaging with the key 14 of the base support 10 (FIGS. 3, 5) and for controlling the handle device 3.

For example, when the handle device 3 is removed or disengaged or separated from the key 14 of the base support 10, as shown in FIG. 5, the spring biased latch 35 may latch or lock the hand grip 34 to the handle bar 30 and may prevent the hand grip 34 from being pivoted or rotated relative to the handle bar 30. On the contrary, as shown in FIG. 3, when the handle device 3 is supported in the base support 10 and when the key 14 of the base support 10 is contacted or engaged with the spring biased latch 35, the hand grip 34 of the handle device 3 is released and is allowed to be pivoted or rotated relative to the base support 10 and the handle bar 30. However, the above-described structure or configuration for the spring biased latch 35 and the key 14 of the base support 10 is not related to the present invention and will not be described in further details.

Figure 9:
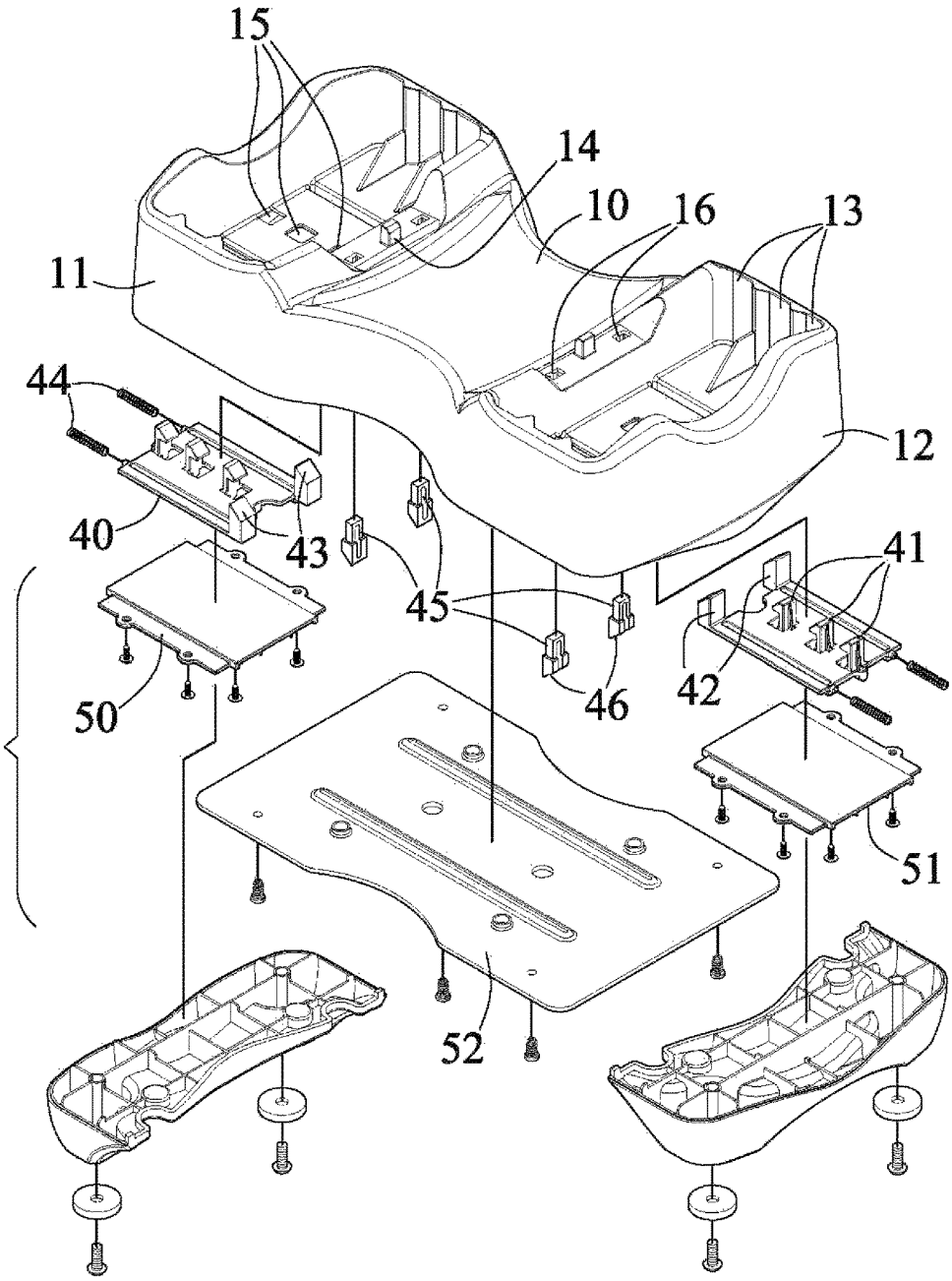
FIG. 9 is another partial exploded view illustrating the base support of the adjustable dumbbell assembly.

As shown in FIGS. 1-4 and 9, the base support 10 further includes one or more (such as six) orifices 15 formed therein, such as three orifices 15 formed in each of the end portions 11, 12 of the base support 10 and aligned with and/or communicating with the socket openings 13 of the base support 10 respectively, and further includes one or more (such as two) apertures 16 formed in each of the end portions 11, 12 of the base support 10 and located close to or beside the keys 14 of the base support 10 (FIG. 9). The base support 10 further includes a compartment or chamber 17 formed and provided in each of the end portions 11, 12 thereof, such as formed in the lower or bottom portion 18 of the base support 10 and communicating with the orifices 15 and the apertures 16 of the base support 10.

The base support 10 further includes one or more (such as two) sliding members or followers 40 slidably received or engaged in the chambers 17 of the base support 10 respectively, and the followers 40 each include one or more (such as three) hooks or catches 41 extended upwardly therefrom and slidably engaged into or through the orifices 15 of the base support 10 respectively, and each include one or more (such as two) studs or protrusions 42 also extended upwardly therefrom and aligned with and/or located below the apertures 16 of the base support 10 respectively, and the protrusions 42 each include a tapered or tilted or inclined surface 43 formed or provided on top thereof. One or more (such as two) spring biasing members 44 are contacted or engaged with the respective followers 40 for biasing and forcing the follower 40 to move toward the key 14 of the base support 10.

One or more (such as four) actuator buttons 45 are slidably received or engaged in the apertures 16 of the base support 10 respectively and partially extended upwardly and outwardly through the apertures 16 of the base support 10 respectively, and each include a tapered or tilted or inclined surface 46 formed or provided on the lower or bottom portion of the respective actuator button 45 for slidably and selectively engaging with the corresponding inclined surface 43 of the protrusion 42 (FIGS. 4, 6) for allowing the followers 40 to be forced and moved to engage with and to compress the spring biasing members 44 and to move the protrusions 42 and the catches 41 away from the key 14 of the base support 10.

Figure 6:
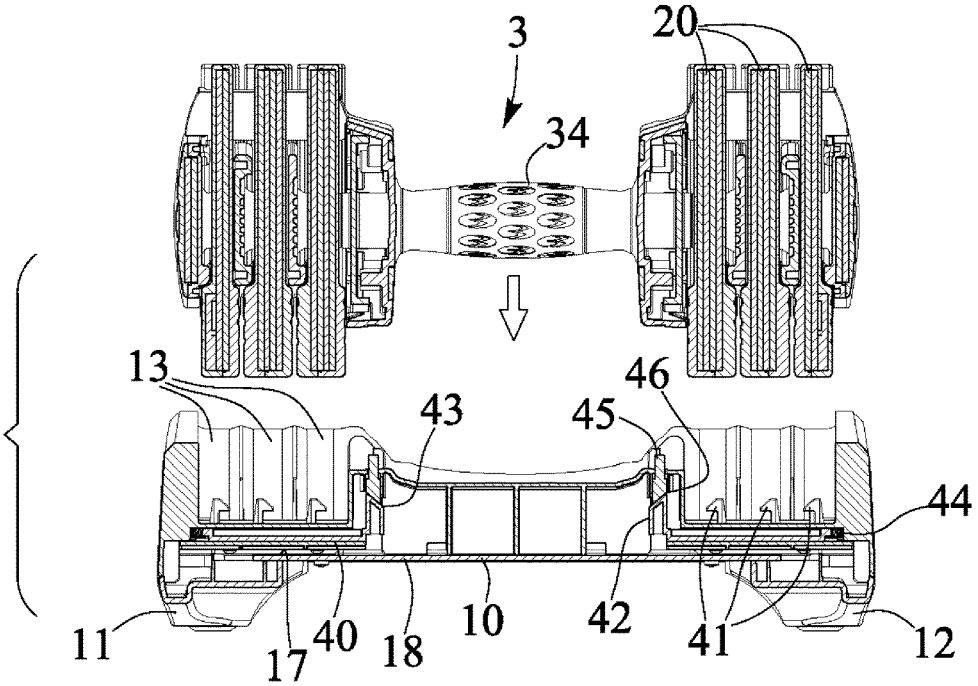
FIG. 6 is a still further cross sectional and exploded view of the adjustable dumbbell assembly similar to FIG. 4, in which the handle and the weight members are removed or separated from the base support.
Figure 7:
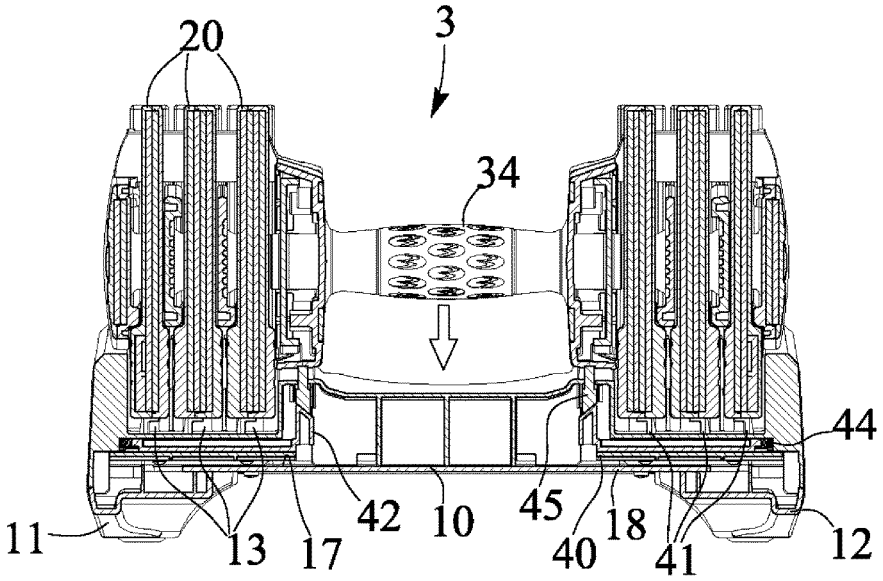
FIG. 7 is a still further cross sectional view of the adjustable dumbbell assembly similar to FIGS. 4 and 6, in which the handle and the weight members are partially separated from the base support.

In operation, as shown in FIGS. 1 and 6-7, when or before the handle device 3 is engaged onto the actuator buttons 45, or when the handle device 3 is disengaged or separated from the actuator buttons 45, the spring biasing members 44 may bias and force the catches 41 of the followers 40 to move toward the key 14 of the base support 10 and to engage with the lock notches 22 of the weight members 20 (FIG. 8) that are left and/or supported on the base support 10, for selectively anchoring or latching or retaining the selected numbers of the weight members 20 to the base support 10 and for preventing the weight members 20 from being disengaged or removed or separated from the base support 10 inadvertently. At this moment, the actuator buttons 45 are forced to move and to partially extend outwardly through the apertures 16 of the base support 10 respectively On the contrary, as shown in FIGS. 2-4, when the handle device 3 is engaged onto the actuator buttons 45, the followers 40 may be forced and moved to engage with and to compress the spring biasing members 44 with the sliding engagement between the inclined surfaces 43, 46 of the protrusions 42 and the actuator buttons 45 (FIGS. 3, 4), and to move the protrusions 42 and the catches 41 away from the key 14 of the base support 10, and thus to disengage or separate or move the catches 41 of the followers 40 from the lock notches 22 of the weight members 20 (FIG. 3), and thus for allowing the weight members 20 and thus the handle device 3 to be disengaged or removed or separated from the base support 10 when required.

As shown in FIG. 9, the base support 10 may further include one or more (such as two) caps 50, 51 attached or mounted or secured to the lower or bottom portion 18 of the base support 10 for blocking or enclosing the chambers 17 of the base support 10 respectively and for solidly and stably anchoring or retaining or positioning the followers 40 within the chambers 17 of the base support 10 respectively and for preventing the followers 40 from being disengaged or removed or separated from the base support 10. A cover 52 may further be provided and attached or mounted or secured to the lower or bottom portion 18 of the base support 10 for engaging with the caps 50, 51 and for solidly and stably anchoring or retaining or positioning the caps 50, 51 to the lower or bottom portion 18 of the base support 10.

Figure 2:
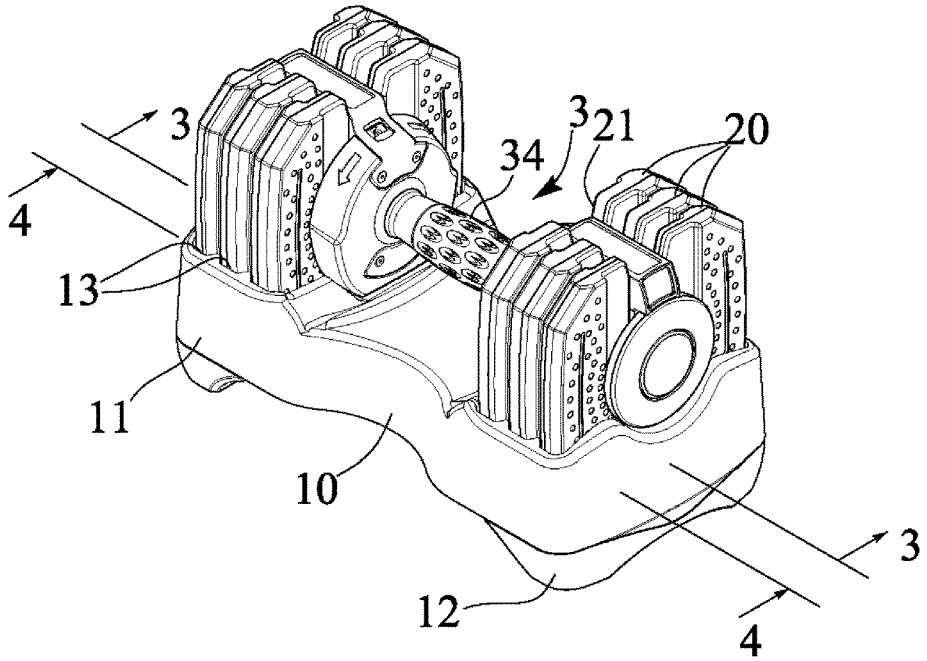
FIG. 2 is a perspective view of the adjustable dumbbell assembly.
Figure 4:
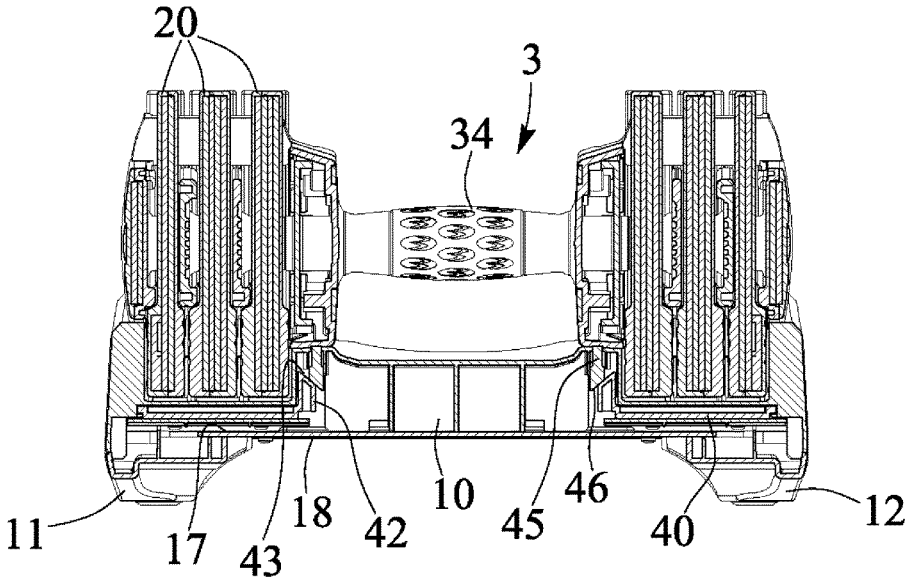
FIG. 4 is another cross sectional view of the adjustable dumbbell assembly, taken along lines 4-4 of FIG. 2.

In operation, as shown in FIGS. 2-4, when the weight members 20 are received or engaged in the socket openings 13 of the base support 10 respectively and when the handle device 3 is engaged onto the actuator buttons 45, the handle device 3 may be contacted or engaged with the actuator buttons 45 to force and move the followers 40 to compress the spring biasing members 44 and to disengage or separate or move the catches 41 of the followers 40 from the lock notches 22 of the weight members 20 (FIG. 3), and thus for allowing the weight members 20 and thus the handle device 3 and the selected numbers of the weight members 20 to be disengaged or removed or separated from the base support 10 when required.

Figure 8:
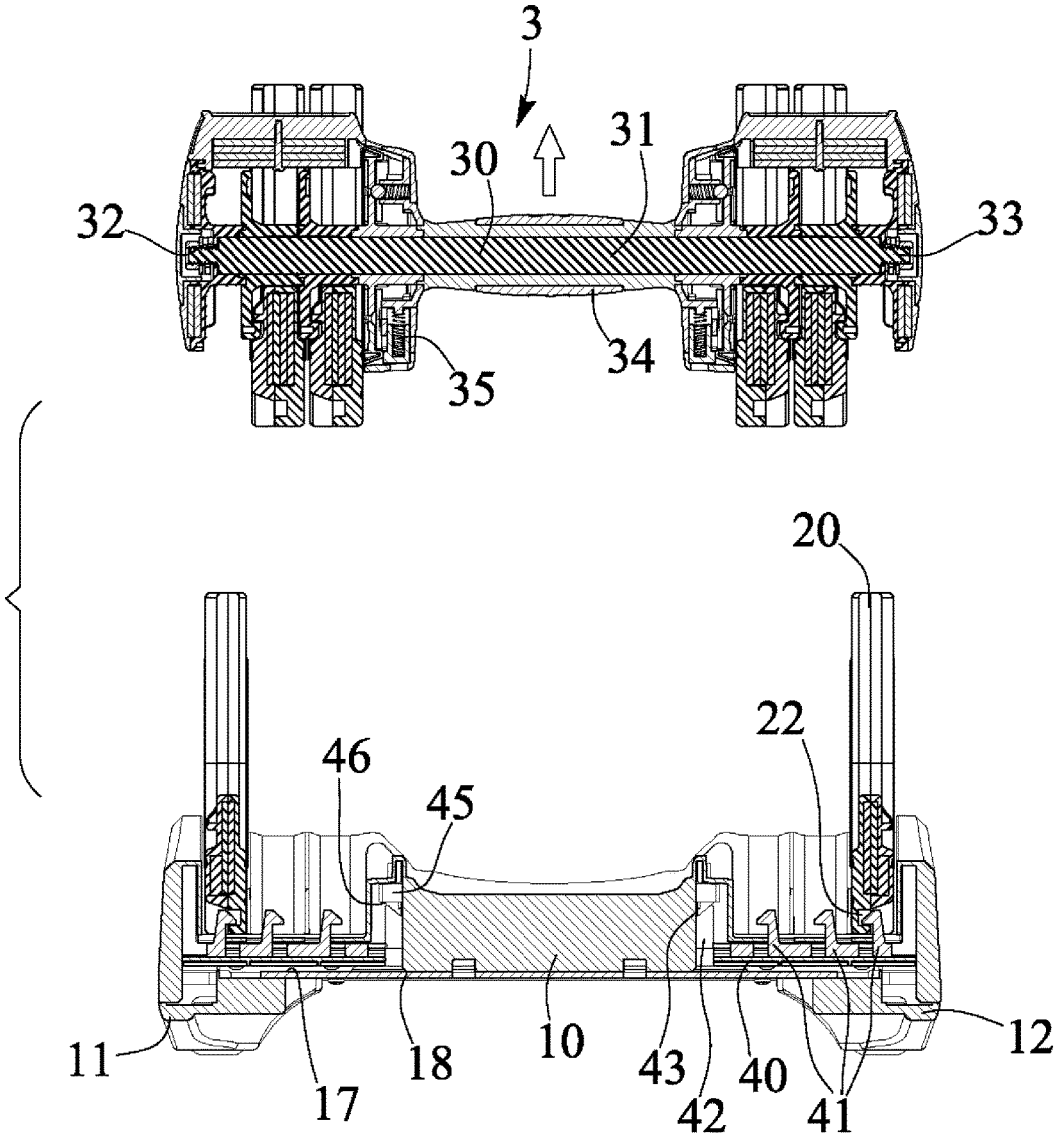
FIG. 8 is a still further cross sectional and exploded view of the adjustable dumbbell assembly similar to FIG. 5, illustrating the operation of the adjustable dumbbell assembly.

As shown in FIG. 8, when the handle device 3 and the selected numbers of the weight members 20 are disengaged or removed or separated from the base support 10 and when the selected numbers of the weight members 20 are left and/or supported on the base support 10, the spring biasing members 44 may bias and force the catches 41 of the followers 40 to engage with the lock notches 22 of the weight members 20 that are left and/or supported on the base support 10 and to selectively anchor or latch or retain the selected numbers of the weight members 20 to the base support 10 and for preventing the weight members 20 from being disengaged or removed or separated from the base support 10 inadvertently, particularly when or after the handle device 3 and the selected numbers of the weight members 20 are disengaged or removed or separated from the base support 10.

Accordingly, the adjustable exercise device or dumbbell assembly in accordance with the present invention includes an improved base support for solidly and stably anchoring or positioning the weight members to the base support and for preventing the weight members from being disengaged or removed or separated from the base support inadvertently.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A dumbbell assembly comprising:

a plurality of weight members, a handle device selectively engageable with said weight members for selectively anchoring a selected number of said weight members to said handle device, a base support including a plurality of socket openings formed therein for accommodating said weight members respectively, and a follower slidably engaged in said base support, and said follower including at least one catch extended therefrom for selectively engaging with said weight members that are supported on said base support and for selectively retaining said weight members to said base support, and said base support including a chamber formed therein for slidably engaging with said follower, said base support including a cap attached thereto for enclosing said chamber of said base support and for retaining said follower within said chamber of said base support.

2. The dumbbell assembly as claimed in claim 1, wherein said weight members each include a lock notch formed therein for selectively engaging with said at least one catch of said follower.

3. The dumbbell assembly as claimed in claim 1, wherein said base support includes a spring biasing member engaged with said follower for biasing and forcing said at least one catch of said follower to engage with said weight members.

4. The dumbbell assembly as claimed in claim 3, wherein said base support includes an actuator button slidably engaged in said base support and partially extended out through said base support for selectively moving said follower to compress said spring biasing member.

5. The dumbbell assembly as claimed in claim 4, wherein said base support includes an aperture formed therein for slidably engaging with said actuator button and for allowing said actuator button to be partially extended out through said aperture of said base support.

6. The dumbbell assembly as claimed in claim 1, wherein said base support includes at least one key extended therefrom.

7. A dumbbell assembly comprising:

a plurality of weight members, a handle device selectively engageable with said weight members for selectively anchoring a selected number of said weight members to said handle device, a base support including a plurality of socket openings formed therein for accommodating said weight members respectively, a follower slidably engaged in said base support, and said follower including at least one catch extended therefrom for selectively engaging with said weight members that are supported on said base support and for selectively retaining said weight members to said base support, said base support including a spring biasing member engaged with said follower for biasing and forcing said at least one catch of said follower to engage with said weight members, said base support including an actuator button slidably engaged in said base support and partially extended out through said base support for selectively moving said follower to compress said spring biasing member, wherein said follower includes a protrusion having an inclined surface provided thereon, and said actuator button includes an inclined surface provided thereon for slidably engaging with said inclined surface of said protrusion.

* * * * *